US006505469B1

(12) United States Patent
Drube et al.

(10) Patent No.: US 6,505,469 B1
(45) Date of Patent: Jan. 14, 2003

(54) GAS DISPENSING SYSTEM FOR CRYOGENIC LIQUID VESSELS

(75) Inventors: Paul Drube, Burnsville, MN (US); Paul Sjogren, Chauhassen, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 09/978,915

(22) Filed: Oct. 15, 2001

(51) Int. Cl.[7] ..... F17C 9/02
(52) U.S. Cl. ..... 62/48.1
(58) Field of Search ..... 62/45.1, 48.1

(56) References Cited

U.S. PATENT DOCUMENTS 3,827,246 A * 8/1974 Moen et al. ..... 62/50
4,548,335 A 10/1985 Remes et al.
4,608,831 A * 9/1986 Gustafson ..... 62/55
4,674,289 A 6/1987 Andonian
4,947,651 A 8/1990 Nesser et al.
5,111,666 A 5/1992 Klok et al.
5,121,609 A 6/1992 Cieslukowski
5,136,852 A 8/1992 Neeser et al.
5,231,838 A 8/1993 Cieslukowski
5,357,758 A 10/1994 Andonian
5,375,423 A 12/1994 Delatte
5,442,927 A 8/1995 Germain
5,924,291 A * 7/1999 Weiler et al. ..... 62/50.2
5,937,655 A * 8/1999 Weiler et al. ..... 62/50.1
6,276,143 B1 * 8/2001 Wimberly ..... 62/50.2

* cited by examiner

*Primary Examiner*—William C. Doerrler
*Assistant Examiner*—Malik N. Drake
(74) *Attorney, Agent, or Firm*—Piper Rudnick

(57) ABSTRACT

A cryogenic vessel features an inner tank containing cryogenic liquid with a head space above and a jacket surrounding the inner tank. An internal pressure builder coil is helically disposed about the inner tank, connected to the jacket and in communication with the bottom of the inner tank. An external pressure building heat exchanger is connected to the internal pressure builder coil and the head space of the inner tank. Liquid from the inner tank flows into the internal pressure builder coil and the exiting fluid is driven by a resulting pumping action to the external pressure building heat exchanger where it is vaporized and warmed. The warmed gas is directed to the head space of the inner tank to rapidly build the pressure therein. Gas may be dispensed directly from the head space of the vessel via an economizer valve. Alternatively, liquid may be withdrawn from the inner tank by a dip tube and vaporized in a vaporizer and dispensed.

17 Claims, 2 Drawing Sheets

GAS DISPENSING SYSTEM FOR CRYOGENIC LIQUID VESSELS

BACKGROUND OF THE INVENTION

The present invention relates generally to systems for dispensing cryogenic gases from vessels storing cryogenic liquids and, more particularly, to a dispensing system for cryogenic liquid vessels that provides cryogenic gas at high pressures and high flow rates.

Cryogenic gases are used in a variety of industrial and medical applications. Many of these applications require that the cryogen be supplied as a high pressure gas. For example, high pressure nitrogen and argon gases are required for laser welding while high pressure nitrogen, oxygen and argon gases are required for laser cutting. Such cryogens are typically stored as liquids in vessels, however, because one volume of liquid produces many volumes of gas (600–900 volumes of gas per one volume of liquid) when the liquid is permitted to vaporize/boil and warm to ambient temperature. To store an equivalent amount of gas requires that the gas be stored at very high pressure. This would require heavier and larger tanks and expensive pumps or compressors.

Cryogenic vessels typically consist of an insulated double-walled tank for storing cryogenic liquids. It is impossible, however, to prevent all heat transfer between the interior of the tank and the external environment. As a result, the cryogenic liquid in the tank will slowly expand, and eventually vaporize, so as to pressurize the tank. Cryogenic gas will collect in the head space of the tank. Because the cryogen is used as a gas, it is advantageous to use the gas in the head space before vaporizing the liquid within the tank. Using gas from the head space reduces pressure in the head space so that venting may be avoided.

A disadvantage with supplying cryogenic gas from the head space of the tank is that the head space pressure will not always be sufficient to meet the use requirements. When the head space pressure is insufficient, the liquid in the tank must be vaporized to meet the use requirements and rebuild the head space pressure.

A prior art dispensing system that coordinates the supply of cryogenic gas from the head space and liquid body of a tank is illustrated in FIG. 1. Such a system is available from Chart Inc. of Burnsville, Minn., owner of the present application. As illustrated in FIG. 1, the system includes a cryogenic liquid storage vessel, indicated in general at 6, including an inner tank 8 and a jacket 10. The inner tank 8 holds a supply of cryogenic liquid, shown at 12. The head space 14 of the inner tank contains cryogenic gas that forms due to the transfer of heat between the interior of the inner tank of the vessel and the external environment.

To further pressurize the vessel, a pressure builder coil 16 is connected to the bottom of inner tank 8 via liquid feed and trap 17 and helically disposed around inner tank 8 and in contact with jacket 10. The cryogenic liquid is free to flow from the inner tank into coil 16. Because pressure building coil 16 is in contact with the jacket 10 of the vessel, heat transfer between the external environment and the liquid in coil 16 will be relatively great. As a result, the cryogenic liquid in the coil will be vaporized. Coil 16 is connected to pressure building line 18 which communicates with the head space 14 of vessel 6 via a circuit 19 that includes a pressure building valve 20 and a pressure building regulator 22 (preferably a diaphragm regulator) and a return line 24.

In addition, return line 24 connects the head space 14 of vessel 6 to a by-pass line 26 containing an economizer regulator 28. By-pass line 26 and regulator 28 connects circuit 19 and return line 24 to a vaporizer line 29 and a vaporizer 30 that is connected to a gas use line 32. Like coil 16, vaporizer 30 is helically disposed about the inner tank 8 and connected to the jacket 10 of vessel 6 such that heat transfer to vaporizer 30 will be great enough to vaporize any cryogenic liquid therein before it is delivered to gas use line 32. Gas use line 32 includes a gas use valve 34 for controlling the delivery of gas for its intended use. A dip tube 36 having a lower end positioned within the cryogenic liquid 12 also communicates with vaporizer line 29, and thus, vaporizer 30 and gas use line 32.

Economizer regulator 28 is set to close when the pressure within the head space 14 of the vessel 6 drops below a first predetermined level. Pressure building regulator 22 is set to open when the pressure within the head space drops below a second predetermined level that is lower than the first predetermined level at which the economizer regulator 28 is set to close. As such, pressure building and economizer regulators 22 and 28, respectively, are never open simultaneously.

To dispense cryogenic gas, gas use valve 34 is opened. When the pressure within the head space 14 of vessel 6 is above the pressure setting of economizer 28, so that economizer 28 is open, gas travels from the head space 14 of the vessel 6 through return line 24, by-pass line 26, vaporizer line 29, vaporizer 30 and ultimately to gas use line 32.

If the pressure of head space 14 falls below the first predetermined value set at economizer regulator 28, economizer 28 will close. Under such circumstances, when gas use valve 34 is open, cryogenic liquid is withdrawn from the inner tank 8 via dip tube 36 and directed to vaporizer coil 30. The liquid is converted to gaseous cryogen in the vaporizer coil and is delivered to valve 34 via use line 32.

If the pressure of head space 14 falls below the second predetermined value set at pressure building regulator 22, regulator 22 opens and, if pressure building valve 20 is open, liquid is removed from the bottom of inner tank 8 via feed 17 and enters pressure building coil 16 where it is vaporized and delivered to pressure building line 18. The resulting gas will flow through circuit 19 and, because economizer regulator 28 is closed, through return line 24 so that the head space 14 is pressurized.

Industrial applications such as laser welding and cutting require that the cryogenic gases be provided simultaneously at high pressures and flow rates. Advances in industrial laser technologies have resulting in demands for increased flow rates. Pressures in the range of approximately 400–420 psig and flow rates in the range of approximately 1500–2500 scfh are now typical. While the system described above is effective at dispensing gases at such pressure levels, and indeed up to around 500 psig, it encounters difficulties in maintaining these operating pressures at such high flow rates.

Accordingly, it is an object of the present invention to provide a gas dispensing system for cryogenic liquid vessels that is capable of delivering high pressure gas at high flow rates.

It is another object of the present invention is to provide a gas dispensing system for cryogenic liquid vessels that may be retrofitted to earlier cryogenic liquid vessels and gas dispensing systems.

It is another object of the present invention to provide a gas dispensing system for cryogenic liquid vessels that is economical to operate.

It is still another object of the present invention to provide a gas dispensing system for cryogenic liquid vessels that is inexpensive to produce and maintain.

Other objects and advantages will be apparent from the remaining portion of this specification.

SUMMARY OF THE INVENTION

The present invention is directed to a system for dispensing pressurized cryogenic gas at high flow rates. The system includes a storage vessel having a jacket surrounding an inner tank that contains a supply of cryogenic liquid with a head space there above. An internal pressure builder coil is positioned between the jacket and inner tank, is in contact with the jacket and is helically positioned about the inner tank. An external pressure building heat exchanger is in communication with the internal pressure builder and the head space of the inner tank of the storage vessel. As a result, cryogenic liquid from the inner tank flows into the internal pressure builder coil and is, as a result of heat added by the internal pressure builder, at least partially vaporized so that a gas and liquid mixture is produced. This produces a pumping action so that the gas and liquid mixture is driven to the external pressure building heat exchanger where the liquid is vaporized and the gas is heated. The resulting heated gas is delivered to the head space of the inner tank so that the inner tank is pressurized. A pressure building regulator is in circuit with the external pressure building heat exchanger and the internal pressure builder coil and opens to allow liquid to enter the internal pressure builder coil when the pressure within the head space of the vessel drops to a predetermined level.

A dip tube is in communication with the cryogenic liquid within the inner tank and a vaporizer is in circuit between a use line and the dip tube. The vaporizer coil may be positioned between the inner tank and the jacket, and in contact with the latter, or external to the tank. Liquid from the inner tank flows through the dip tube and the vaporizer so that gas produced thereby may be dispensed from the use line. The vaporizer selectively communicates with the dip tube and is selectively in communication with the head space of the vessel through an economizer regulator so that when the economizer regulator is open, gas from the head space flows through the vaporizer to the use line and when the economizer regulator is closed, liquid from the inner tank travels through the dip tube and vaporizer so that gas is produced and provided to the use line.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 2:
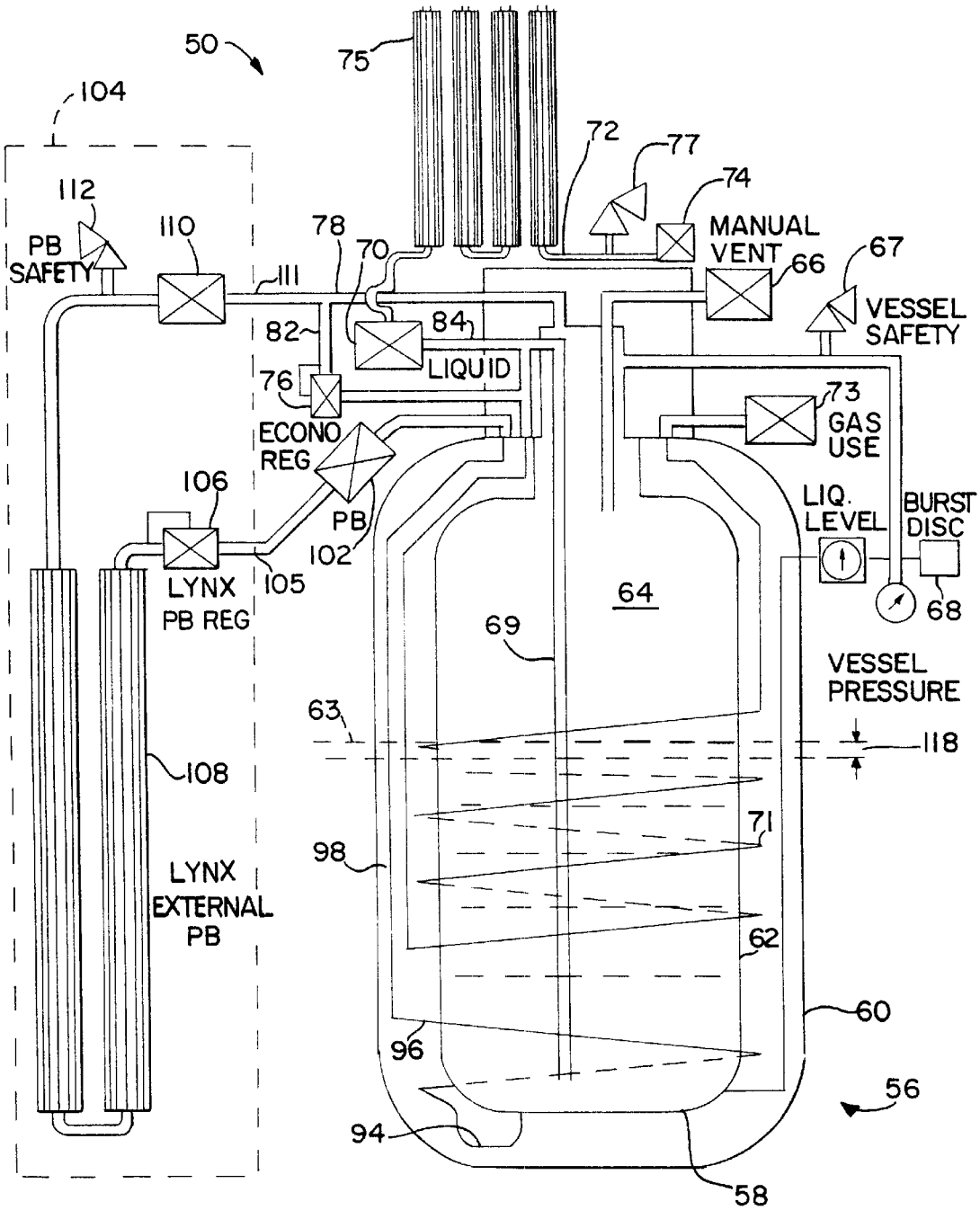
FIG. 2 is a schematic view of an embodiment of the cryogenic vessel gas delivery system of the present invention.

An embodiment of the system of the present invention is indicated in general at 50 in FIG. 2. A cryogenic liquid storage vessel, indicated in general at 56, includes an inner tank 58 and outer jacket 60. The inner tank is filled with cryogenic liquid 62, such as liquid nitrogen or argon, to the level indicated in phantom by line 63. In other words, line 63 corresponds to the surface of the liquid 62 within the inner tank. A head space 64 is above the liquid.

A manual vent valve 66 that communicates with head space 14 is provided in the event that it is necessary to vent the tank manually, such as during maintenance. In addition, relief valve 67, which also communicates with head space 14, opens automatically when a predetermined pressure limit is reached to prevent over-pressurization of the vessel. As is known in the art, a burst disc 68 further ensures that under extreme conditions, the vessel 56, and other system components, will not be damaged from an abnormally large pressure build up.

A dip tube 69 communicates with a manual liquid valve 70 so that the system may dispense pressurized cryogenic liquid. An internal vaporizer 71 also communicates with the dip tube 69 so that cryogenic liquid from the inner tank 58 may be vaporized and dispensed via gas use valve 73. The internal vaporizer 71 on many current tanks, however, typically has a diameter of only approximately ⅜". This causes a large pressure drop across internal vaporizer 71 when gas is dispensed at a very high flow rate. In response, an external vaporizer 75 is connected to manual liquid valve 70.

While internal vaporizer 72 and gas use valve 73 may be used to deliver gas at low flow rates, the system of FIG. 2 dispenses high pressure gas at a high flow rate through a gas use line 72 to an application such as laser cutting when valve 70 and gas use valve 74 are opened. This gas comes from the head space 64 of vessel 56 when the pressure of the head space is above the setting of economizer regulator 76. When economizer regulator 76 is open, gas from head space 64 flows through return line 78, by-pass line 82 and into liquid use line 84. The gas then passes through external vaporizer 75. The outlet of external vaporizer 75 is in communication with gas use line 72 and gas use valve 74. Gas use line 72 is provided with a relief valve 77.

Economizer regulator 76 closes when the pressure within the head space 64 of the vessel drops below a predetermined level, for example, approximately 475 psi. When economizer 76 closes, cryogenic liquid is withdrawn from the inner tank 58 via dip tube 69. Dip tube 69 communicates with liquid line 84. As a result, the withdrawn liquid is vaporized in external vaporizer 75 due to ambient heat. The resulting gas is directed to gas use line 72. Valve 73 remains closed when external vaporizer 75 is in use so that gas or liquid from the internal tank 58 does not enter internal vaporizer 71.

The inner tank 58 must be sufficiently pressurized to provide the liquid therein to the external vaporizer 75 at a rate and pressure that is sufficient to meed the demands of the process connected to gas use line 72. When the pressure within the inner tank drops below the required level, the system of the present invention provides very rapid pressure building so that the high pressure and flow rates demanded by the process connected to line 72 may be maintained.

A liquid feed and trap 94 is connected to the bottom of the inner tank 58. The liquid feed and trap leads to an internal pressure builder coil 96 that, like internal vaporizer 71, is helically disposed about the inner tank 58 and in contact with the inner surface of jacket 60. The outlet of pressure builder coil 96 communicates with pressure building line 98 which, after passing through a pressure building valve 102, leads to an external pressure building circuit or module 104.

External pressure building circuit 104 includes an inlet 105, a pressure building regulator 106, an external pressure building heat exchanger 108, an isolation valve 110 and an outlet 111. Pressure building regulator 106 preferably has an improved flow performance. In addition, while external pressure building heat exchanger 108 is preferably a finned heat exchanger, as illustrated in FIG. 2, other heat exchanger arrangements known in the art may be used instead. A pressure relief valve 112 is also provided to protect the circuit from over-pressurization. The outlet 111 of the circuit communicates with return line 78 which communicates with the head space 64 of vessel 56. Pressure building valve 102 and isolation valve 110 are opened to place the internal pressure builder coil 96 and head space 64 of vessel 56 in communication with the components of circuit 104.

With valves 102 and 110 open, pressure building regulator 106 detects the pressure within the head space 64 of vessel 56. When the pressure within the head space drops below a predetermined level, for example, 450 psi, pressure building regulator 106 automatically opens. It should be noted that the setting of pressure building regulator is lower than that of economizer regulator 76. As a result, regulators 76 and 106 will never be open simultaneously.

With pressure building regulator 106, and valves 102 and 110, open, liquid exits the bottom of the inner tank 58 through liquid feed and trap 94 and seeks in pressure building line 98 the liquid level 63 of the cryogenic liquid in the vessel. As the liquid flows through the internal pressure builder coil 96 and pressure building line 98, however, heat is added to the liquid making it less dense. As the liquid continues to travel up pressure building line 98, a two-phase gas and liquid flow is created. This creates a pumping action that provides a continual flow of liquid into the inner pressure builder coil 96 and gas or a gas and liquid mixture out of pressure building valve 102.

Pressure builder coil 96 and pressure building line 98 are warm when liquid first begins to flow through them. As a result, the liquid is transformed nearly completely into gas as it flows through pressure builder coil 96 and pressure building line 98. Under such circumstances, mostly gas is delivered to the external pressure builder 108. As pressure builder coil 96 and pressure building line 98 are cooled, a gas and liquid flow of cryogen will be delivered to the external pressure builder 108.

If the relatively cold and dense gas, possibly containing some liquid, exiting pressure building valve 102 were directed to the head space 64 of vessel 56, the pressure building performance of the system would be significantly limited. Instead, the system of the present invention uses the pumping action from the internal pressure builder 96 to drive the vapor and liquid through external pressure building heat exchanger 108. This adds additional heat to the gas to reduce its density and increase its volume.

The warmed gas flows through isolation valve 110, circuit outlet 111, return line 78 and ultimately to the head space 64 of vessel 56. The warmed gas entering the head space replaces the gas withdrawn for the use process, or occupies the additional head space resulting from liquid withdrawn from the vessel to supply gas for the use process. As a result, the pressure within the vessel is maintained. This permits the high flow rate of high pressure gas to the use process to be maintained.

No interruption in the delivery of the gas occurs in that external pressure building circuit 104 may function simultaneously with the withdraw and vaporization of liquid from the vessel by dip tube 69 and external vaporizer 75, respectively. If no gas or liquid is being withdrawn from the vessel, the pressure therein may be built even more rapidly using external pressure building circuit 104. Indeed, pressure building of approximately 150 psi per minute is possible.

Pressure building regulator 106 closes when its setting is exceeded by the pressure within the head space of the vessel. Depending upon the settings of pressure building regulator 106 and economizer regulator 76, liquid may continue to be withdrawn from inner tank 58 through dip tube 69 to produce gas for the use process, or gas may be withdrawn from the head space 64 for the use process.

The system of the present invention thus provides a flow of warm gas to the head space of the vessel to provide rapid pressure building. This goes against prior art systems, methods and practices in that, prior to the present invention, it was believed that pressure building gas introduced to a head space should be at the same temperature as the cryogenic liquid below. It was believed that the addition of warmer cryogen into the tank was inefficient. As such, prior art pressure building systems provide only enough heat to simply change the state of cryogen used for pressure building from a liquid to a gas. No additional heat to warm and reduce the density of the gas is provided.

The system of the present invention, however, provides a significant stratification of the head space 64 of the inner tank 58. More specifically, the warmed gas from external pressure building circuit 104 remains near the top of head space 64 while the coolest gas drops to the surface 63 of the liquid. Furthermore, the warmest liquid rises towards the surface 63 of the liquid 62 stored in inner tank 58. The coolest liquid drops to the bottom of the inner tank 58. As a result, the portions of the gas and liquid within the vessel that are closest to one another in temperature are positioned adjacent to one another. This minimizes the heat transfer between the head space and liquid so that a region of minimal heat transfer or a "thermo-liquid barrier," indicated at 118 in FIG. 2, is formed adjacent to the liquid surface 63.

In effect, inner tank 58 is divided into two sub-tanks by the thermo-liquid barrier 118, one tank containing liquid while the other contains gas, with very little heat transfer between the two sub-tanks. Thermo-liquid barrier 118 thus allows the vessel to be pressurized with warm gas without significant penalties in terms of warming the liquid within the vessel. This minimizes, or eliminates altogether, the necessity of using economizer regulator 76 to control the pressure within the inner tank.

Figure 1:
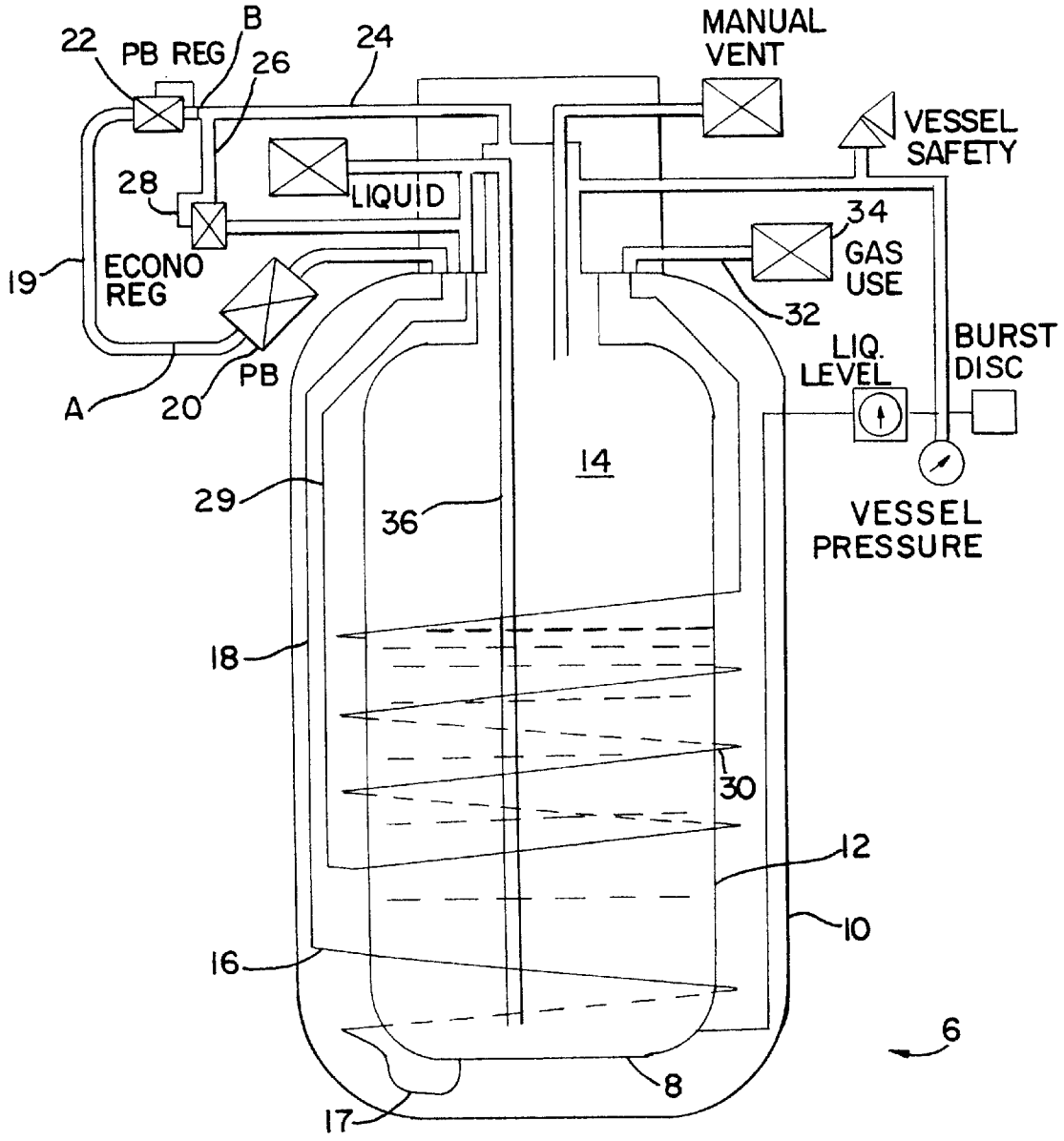
FIG. 1 PRIOR ART
FIG. 1 is a schematic view of a prior art cryogenic vessel gas delivery system.

The system of FIG. 1 may be retrofitted in accordance with the system of the present invention by removing the portion of circuit 19 between pressure building valve 20 and pressure building regulator 22, as well as pressure building regulator 22 itself. The inlet 105 and outlet 111 of the external pressure building circuit or module 104 of FIG. 2 may then be connected to points A and B, respectively, in FIG. 1 by a permanent joining arrangement, such as welding, or by a temporary joining arrangement. Similarly, external vaporizer 75 is attached to valve 70. As such, the external pressure building circuit or module 104 and external vaporizer 75 may be attached permanently to vessel 56, or, the circuit or module 104 and external vaporizer 75 may act as stand alone devices from which empty vessels may be removed and replaced by full vessels.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing pressurized cryogenic fluid comprising:

a) a storage vessel including a jacket and an inner tank with the inner tank positioned in the jacket and the inner tank containing a supply of cryogenic liquid with a head space there above;

b) a use line in communication with the inner tank so that cryogenic fluid may be dispensed therefrom;

c) an internal pressure builder in communication with the inner tank and positioned between the inner tank and the jacket of said storage vessel; and d) an external pressure building heat exchanger in communication with said internal pressure builder and the head space of the inner tank of said storage vessel;

whereby cryogenic liquid from the inner tank flows into said internal pressure builder and, due to heat added by said internal pressure builder, an exiting fluid is driven to said external pressure building heat exchanger where the fluid is heated and a resulting gas is delivered to the head space of the inner tank so that the inner tank is pressurized.

2. The system of claim 1 further comprising a pressure building regulator in circuit with the external pressure building heat exchanger and the internal pressure builder, said pressure building regulator opening to allow liquid to enter the internal pressure builder when the pressure within the head space of the vessel drops to a predetermined level.

3. The system of claim 1 wherein said use line is selectively in communication with the head space of the inner tank so that gas from the head space may be dispensed through the use line.

4. The system of claim 3 further comprising an economizer regulator in circuit between the head space of the storage vessel and the use line, said economizer regulator opening when a pressure within the head space rises to a predetermined level so that gas from the head space may flow to the use line.

5. The system of claim 1 further comprising:

e) a dip tube in communication with the cryogenic liquid within the inner tank; and f) a vaporizer in circuit between the use line and the dip tube;

whereby liquid from the inner tank flows through the dip tube and the vaporizer so that gas produced thereby may be dispensed from the use line.

6. The system of claim 5 wherein said vaporizer selectively communicates with the dip tube and is selectively in communication with the head space of the vessel through an economizer regulator so that when said economizer regulator is open, gas from the head space flows through the vaporizer to the use line and when said economizer regulator is closed, liquid from the inner tank travels through the dip tube and vaporizer so that gas is produced and provided to the use line.

7. The system of claim 6 further comprising a pressure building regulator in circuit with the external pressure building heat exchanger and the internal pressure builder, said pressure building regulator opening to allow liquid to enter the internal pressure builder when the pressure within the head space of the vessel drops to a predetermined level.

8. The system of claim 7 wherein said pressure building regulator is set to open at a first pressure within the head space of the vessel that is lower than a second pressure at which the economizer regulator is set to close.

9. The system of claim 1 wherein said internal pressure builder is a coil that helically surrounds the inner tank and is connected to the jacket.

10. An external pressure building module for increasing a pressure building capability of a cryogenic liquid vessel having a jacket, an inner tank disposed within the jacket and containing a cryogenic liquid with a head space there above, a return line in communication with the head space of the inner tank and an internal pressure builder positioned between the inner tank and jacket and in communication with the inner tank, the external pressure building module comprising:

a) an external pressure building heat exchanger;

b) a pressure building regulator in circuit with the pressure building heat exchanger;

c) an inlet in communication with the heat exchanger and regulator and adapted to be connected to the internal pressure builder of the cryogenic liquid vessel; and d) an outlet adapted to be connected to the return line of the cryogenic liquid vessel;

whereby when the inlet of the module is connected to the internal pressure builder and the outlet of the module is connected to the return line and the pressure building regulator is open, liquid from the inner tank flows to the internal pressure builder and an exiting fluid is driven to the external pressure building heat exchanger so that the fluid is heated and a resulting gas is provided to the head space of the inner tank so that the inner tank is pressurized.

11. The external pressure building module of claim 10 further comprising an isolation valve in circuit with said external pressure building heat exchanger.

12. The external pressure building module of claim 10 further comprising a pressure relief valve in communication with said external pressure building heat exchanger.

13. The external pressure building module of claim 10 wherein said external pressure building heat exchanger is a finned heat exchanger.

14. The external pressure building module of claim 10 further comprising a vaporizer adapted to be connected to a liquid use line of the cryogenic liquid vessel so that cryogenic liquid from the vessel may be vaporized and dispensed.

15. A method for pressurizing a vessel containing cryogenic liquid with a head space there above comprising:

a) providing first and second heat exchanger devices;

b) withdrawing cryogenic liquid from the vessel;

c) warming the cryogenic liquid with ambient heat in the first heat exchanger device so that a cryogenic fluid exiting the first heat exchanger device is driven to the second heat exchanger device;

d) warming the cryogenic fluid from the first heat exchanger device with ambient heat in the second heat exchanger device so that a warmed gas is produced; and e) directing the warmed gas into the head space of the cryogenic liquid vessel.

16. The method of claim 15 further comprising the step of detecting a pressure within the vessel and performing steps a) through e) when the detected pressure drops to a predetermined level.

17. The method of claim 15 further comprising the step of forming a thermo-liquid barrier in the cryogenic liquid in tank as a result of step e).

* * * * *